US005442372A

United States Patent [19]

Shiki

[11] Patent Number: 5,442,372

[45] Date of Patent: Aug. 15, 1995

[54] APPARATUS FOR DRIVING LIQUID CRYSTAL DISPLAY PANEL FOR SMALL SIZE IMAGE

[75] Inventor: Tatsuya Shiki, Tokyo, Japan

[73] Assignee: NEC Corporation, Tokyo, Japan

[21] Appl. No.: 177,322

[22] Filed: Jan. 4, 1994

[30] Foreign Application Priority Data

Jan. 5, 1993 [JP] Japan ..... 5-000162

[51] Int. Cl.[6] ..... G06E 1/00

[52] U.S. Cl. ..... 345/98; 345/100

[58] Field of Search ..... 345/87-100, 345/63

[56] References Cited

U.S. PATENT DOCUMENTS 4,990,902 2/1991 Zenda ..... 345/63 X
4,998,099 3/1991 Ishii ..... 345/100 X
5,170,107 12/1992 Kanno et al. ..... 345/100

FOREIGN PATENT DOCUMENTS 0298390 1/1989 European Pat. Off. .
0344621 12/1989 European Pat. Off. .
0456165 11/1991 European Pat. Off. .
63-178961 11/1988 Japan .
4-204491 7/1992 Japan .
2237713 2/1989 United Kingdom .
WO9012367 10/1990 WIPO .

OTHER PUBLICATIONS

Patent Abstracts of Japan, vol. 17, No. 402 (P-1580), Jul. 27, 1993 and JPA 5-73023.
Patent Abstracts of Japan, vol. 14, No. 264 (P-1057), Jun. 7, 1990 and JPA 2-73394.

*Primary Examiner*—Ulysses Weldon
*Attorney, Agent, or Firm*—Sughrue, Mion, Zinn, Macpeak & Seas

[57] ABSTRACT

In an apparatus for driving a liquid crystal display panel having N scan lines, shift registers are provided to drive the scan lines, and switching circuits are interposed among the shift registers. One of the switching circuits is selected to write a start pulse signal thereinto. Thus, an image having a smaller number of scan lines than N can be displayed at a center portion of the liquid crystal display panel.

8 Claims, 14 Drawing Sheets

PRIOR ART
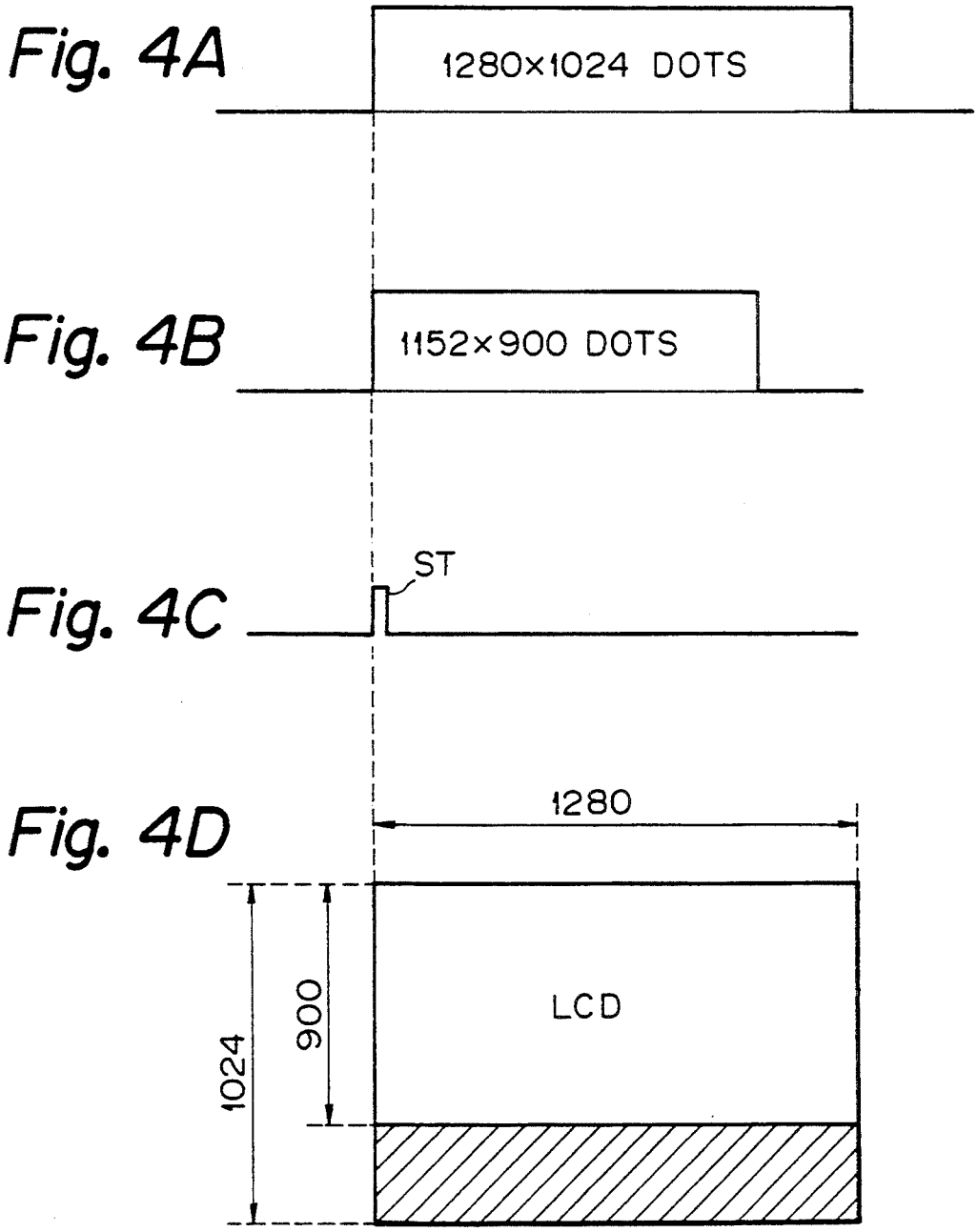

| $f_V$ \ $f_H$ | $f_{H1}$ | $f_{H2}$ | ---- | $f_{HMAX}$ |
|---|---|---|---|---|
| $f_{V1}$ | | | | 0111111111 |
| $f_{V2}$ | | | | |
| | | | | |
| $f_{Vmax}$ | 0000000000 | | | |

Fig. 7

SCK

D0

D1

D61

D62

D63

D64

D1023

| $f_V$ \ $f_H$ | $f_{H1}$ | $f_{H2}$ | ---- | $f_{HMAX}$ |
|---|---|---|---|---|
| $f_{V1}$ | | | | 111111111 |
| $f_{V2}$ | | | | |
| | | | | |
| $f_{Vmax}$ | 000000000 | | | |

Fig. 14

APPARATUS FOR DRIVING LIQUID CRYSTAL DISPLAY PANEL FOR SMALL SIZE IMAGE

BACKGROUND OF THE INVENTION

1. Field of the Invention

The present invention relates to a liquid crystal display (LCD) system, and more particularly, to an apparatus for driving a multi-synchronization type LCD panel for a small size image.

2. Description of the Related Art

There has been known a multi-synchronization type deflecting apparatus for a cathode-ray tube (CRT) panel which can properly display images having different numbers of scan lines at a center portion of the panel. On the other hand, since LCD panels are thinner in size and lower in power consumption with a lower power supply voltage as compared with CRT panels, the LCD panels have recently been applied to personal computers, word processors, color telereceivers, and the like. However, the multi-synchronization type deflecting system of the CRT panels cannot be applied to the multi-synchronization type driving system of the LCD panels, due to the on difference in driving (deflecting) methods therebetween in a prior art apparatus for driving an LCD panel having N scan lines (N=2, 3, . . . ), N serially-connected shift registers are provided to drive the scan lines. That is, a start pulse signal, which is in synchronization with a horizontal synchronization signal, is written into the .first stage of the shift registers, and the start pulse signal is shifted through the shift registers. As a result, an image having a smaller number of scan lines than N is ill-balanced at an upper portion of the LCD panel. This will be explained later in detail.

SUMMARY OF THE INVENTION

It is an object of the present invention to provide a multi-synchronization type driving apparatus for an LCD panel which can display an image having a small number of scan lines at a center portion thereof.

According to the present invention, in an apparatus for driving an LCD panel having N scan lines (N=2, 3, . . . ), shift registers are provided to drive the scan lines, and switching circuits are interposed among the shift registers. One of the switching circuits is selected to write a start pulse signal thereinto. Thus, an image having a smaller number of scan lines than N can be displayed at a center portion of the LCD panel.

BRIEF DESCRIPTION OF THE DRAWINGS

The present invention will be more clearly understood from the description as set forth below, in comparison with the prior art, with reference to the accompanying drawings, wherein:

FIGS. 4A, 4B and 4C are timing diagrams of the image signals displayed on the LCD panel of FIG. 1;

FIG. 4D is a diagram showing images displayed on the LCD panel of FIG. 1

FIG. 7 is a diagram showing the content of the look-up table of FIG. 6;

FIG. 14 is a diagram showing the content of the look-up table of FIG. 13.

DESCRIPTION OF THE PREFERRED EMBODIMENTS

Before the description of the preferred embodiments, a prior art apparatus for driving an LCD panel will be explained with reference to FIGS. 1 2, 3A through 3E, and 4A through 4D.

Figure 1:
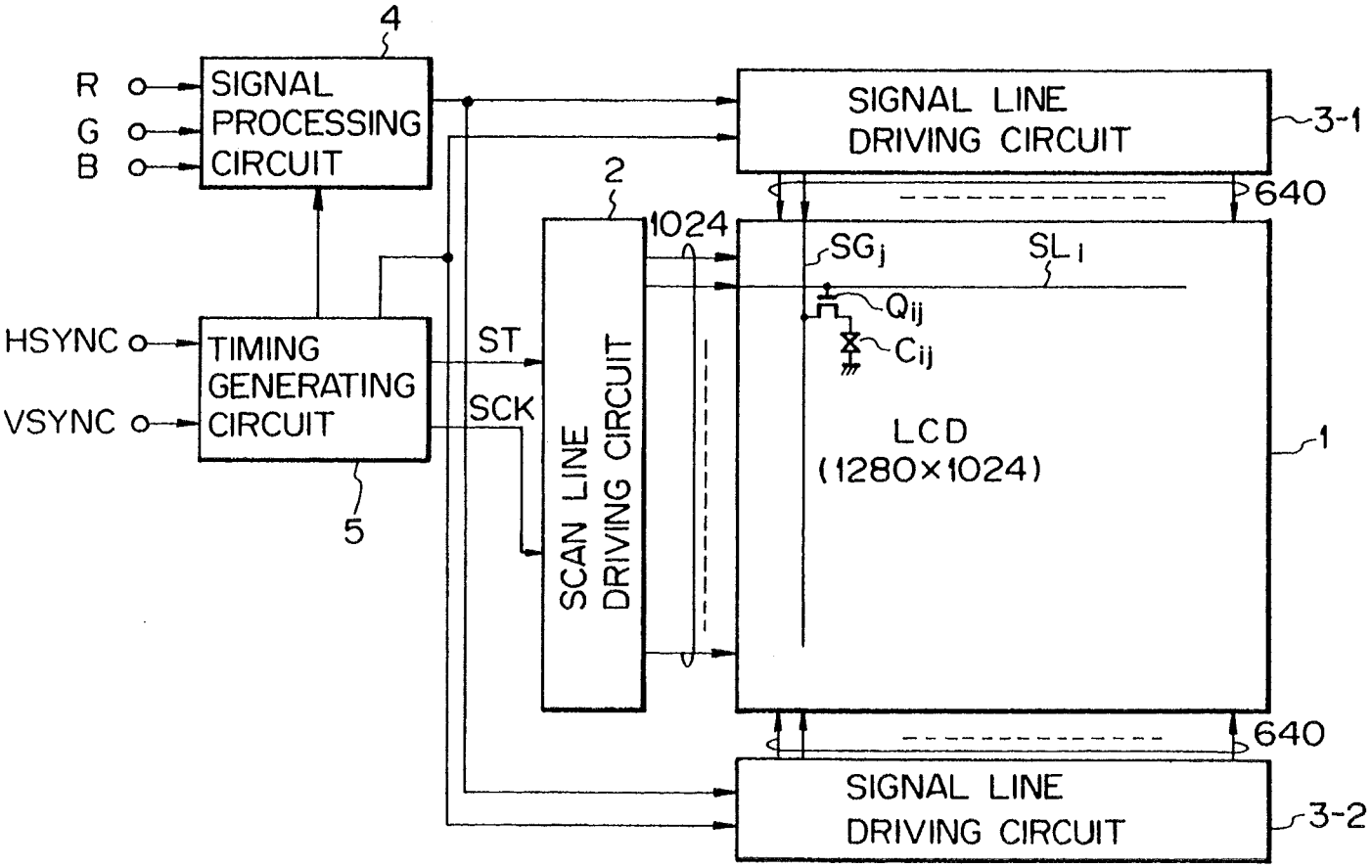
Fig. 1 PRIOR ART
FIG. 1 is a block circuit diagram illustrating a prior art apparatus for driving an LCD panel

In FIG. 1, which illustrates a prior art apparatus for driving an LCD panel, reference numeral 1 designates an LCD panel having M×N dots where M=1280 and N=1024. That is, the LCD panel 1 has 1024 scan lines $SL_i$ (i=0, 1, . . . , 1023) driven by a scan line driving circuit 2, signal lines $SG_j$ (j=0, 1, . . . , 1279) driven by signal line driving circuits 3-1 and 3-2, and pixels each connected to one of the scan lines and one of the signal lines. Also, each of the pixels is formed by a thin film transistor (TFT) $Q_{ij}$ and a liquid crystal cell $C_{ij}$.

A signal processing circuit 4 receives color signals R, G and B, to thereby convert them by using a timing signal from a timing generating circuit 5. The output signal of the signal processing circuit 4 is supplied to the signal line driving circuits 3-1 and 3-2.

The timing generating circuit 5, which includes a phase-locked loop (PLL) circuit, receives a horizontal synchronization signal HSYNC and a vertical synchronization signal VSYNC, to thereby generate various timing signals for controlling the scan line driving circuits 2 and the signal line driving circuits 3-1 and 3-2 in addition to the signal processing circuit 4. For example, the timing generating circuit 5 generates a start pulse signal ST for showing the first scan line of a displayed image in synchronization with the horizontal synchronization signal HSYNC, and a shift clock signal SCK for shifting the scan line of the displayed image in synchronization with the vertical synchronization signal VSYNC.

Figure 2:
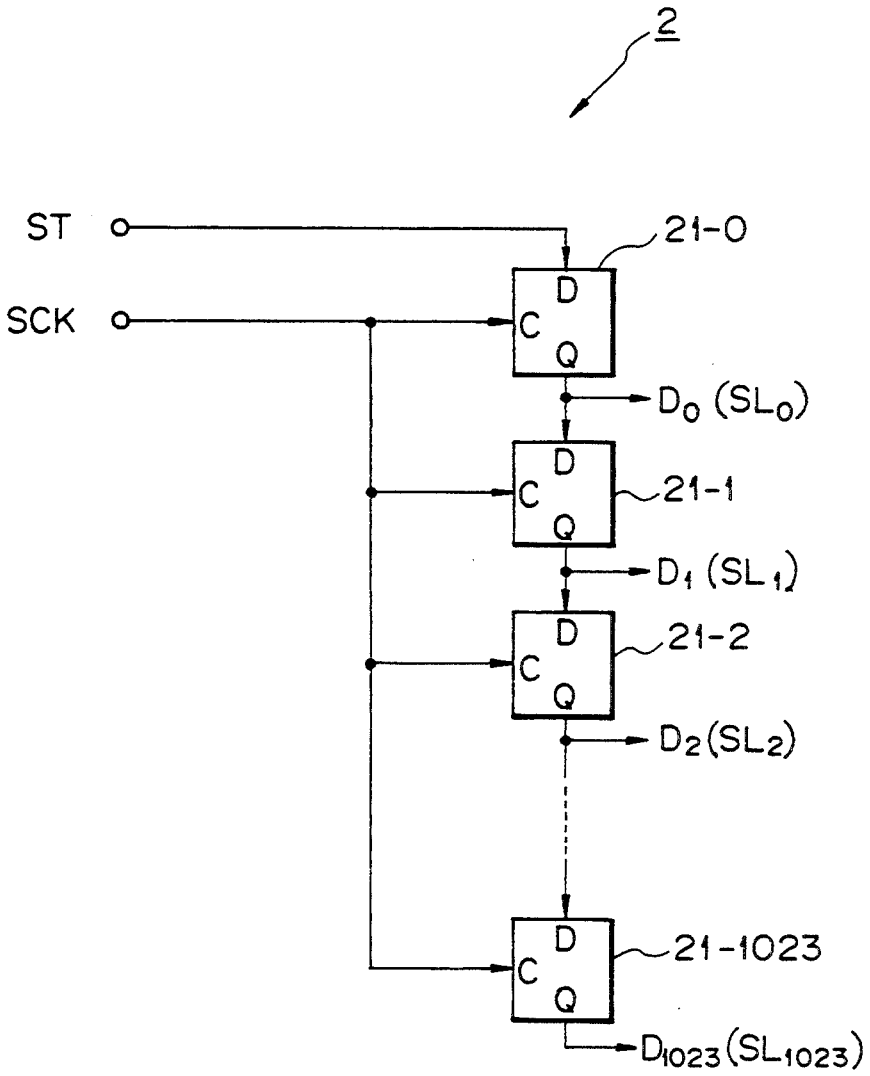
Fig. 2 PRIOR ART
FIG. 2 is a detailed block circuit diagram of the scan line driving circuit of FIG. 1.
Figures 3A, 3B, 3C, 3D, 3E:
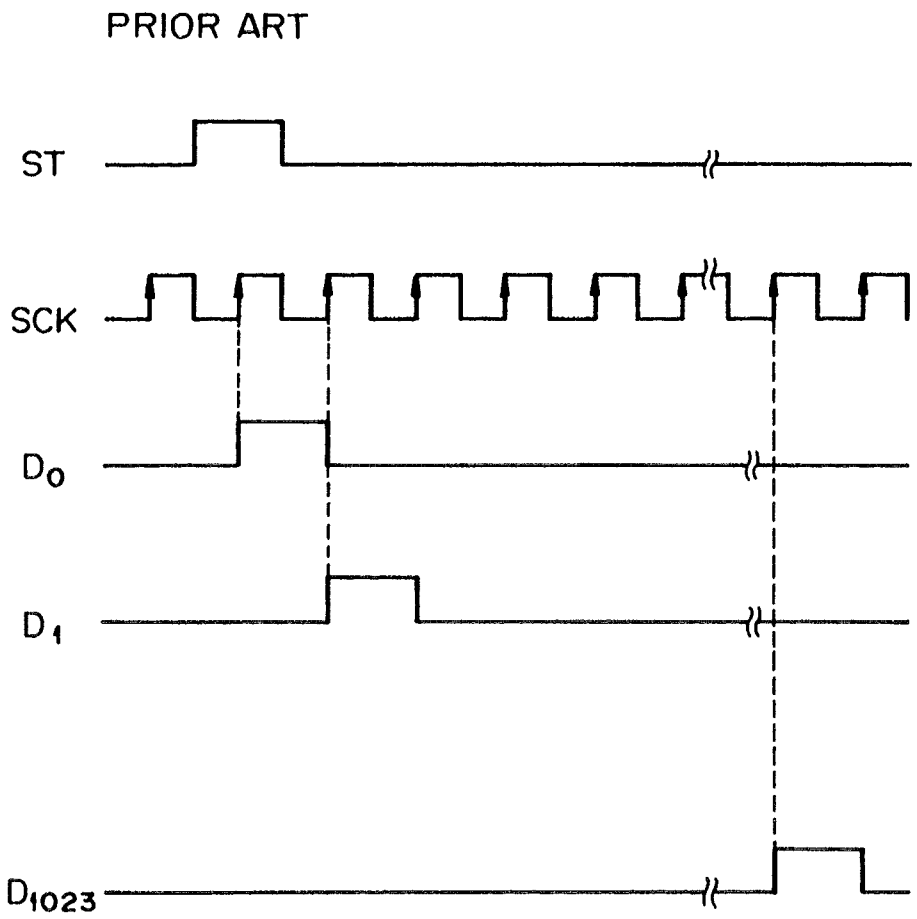
FIGS. 3A through 3E are timing diagrams showing the operation of the circuit of FIG. 2.

In FIG. 2, which is a detailed block circuit diagram of the scan line driving circuit 2 of FIG. 1, shift registers (D flip-flops) 21-0, 21-1, . . . , 21-1023 are serially-connected for driving the scan lines $SL_0$, $SL_1$, $SL_{1023}$, respectively. In FIG. 2, the start pulse signal ST as shown in FIG. 3A is supplied to the first stage of the shift registers, i.e., the shift register 21-0, and the start pulse signal ST is shifted through the shift registers 21-0, 21-1, . . . , 21-1023 by the shift clock signal SCK as shown in FIG. 3B. As a result, the scan lines $SL_0$, $SL_1$, . . . , $SL_{1023}$ are sequentially driven by the output signals $D_0$, $D_1$, . . . , $D_{1023}$ of the shift registers 21-0, 21-1, . . . , 21-1023.

Therefore, even if an image having 1152×900 dots as shown in FIG. 4B, that is smaller than an image having 1280×1024 dots as shown in FIG. 4A, is displayed in the LCD panel 1 having 1280×1024 dots, the timing of the start pulse signal ST is definite as shown in FIG. 4C. As a result, as shown in FIG. 4D, a 1152×900 dot image is ill-balanced at an upper portion of the LCD panel 1.

Figure 5:
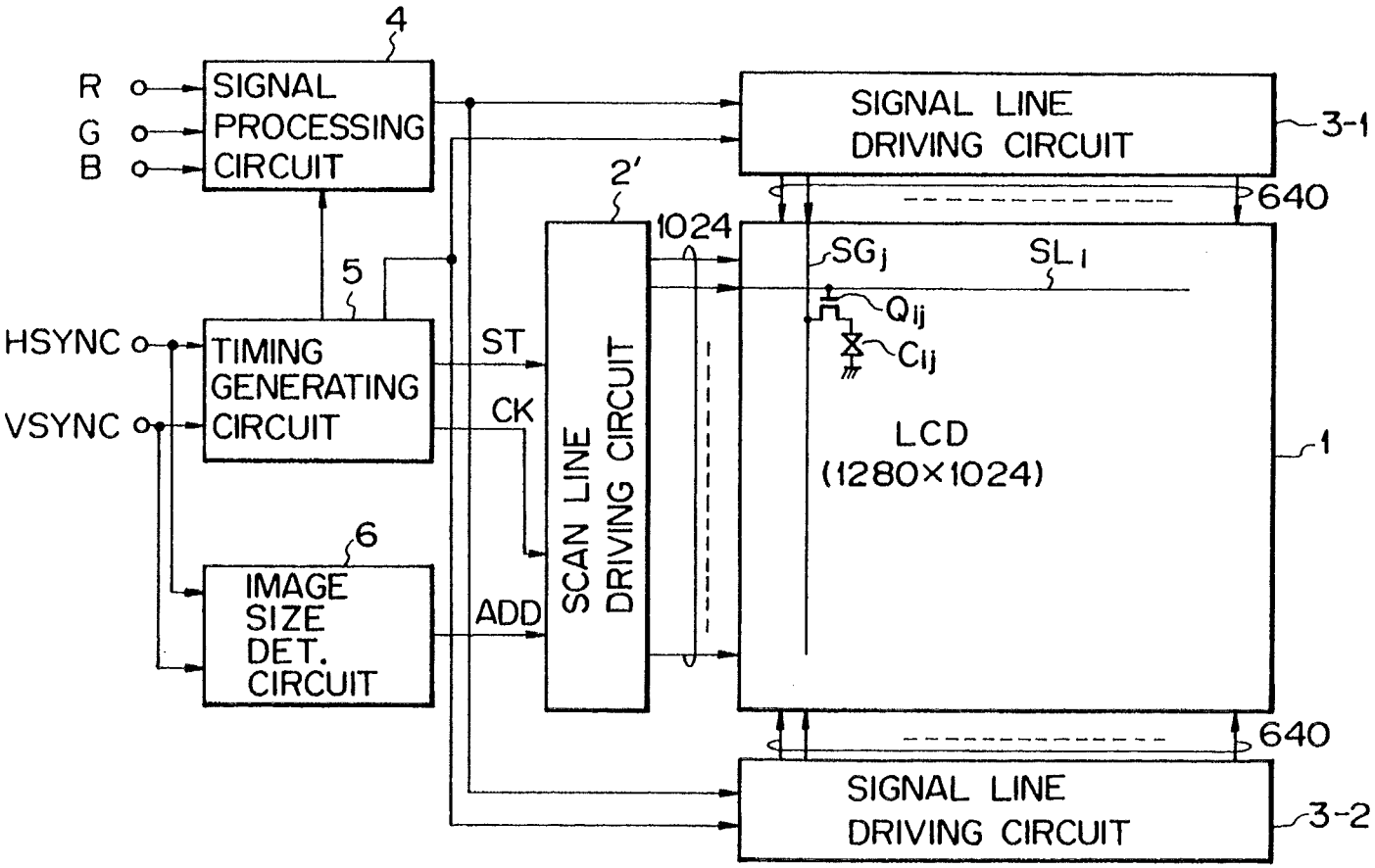
FIG. 5 is a block circuit diagram illustrating an embodiment of the apparatus for driving an LCD panel according to the present invention

In FIG. 5, which illustrates an embodiment of the present invention, an image size determining circuit 6 is added to the elements of FIG. 1, and the scan line driving circuit 2 of FIG. 1 is modified into a scan line driving circuit 2'.

The image size determining circuit 6 calculates ΔN by $$\Delta N=(1024-N')/2 \quad (1)$$

where N' is a number of scan lines of an image to be displayed on the LCD panel 1. In this case, the equation can be replaced by $$\Delta N=(1024-f_H/f_V)/2 \quad (2)$$

where fis a frequency of the horizontal synchronization signal HSYNC and $f_V$ is a frequency of the vertical synchronization signal VSYNC. Therefore the image size determining circuit 6 is formed by a circuit as illustrated in FIG. 6.

Figure 6:
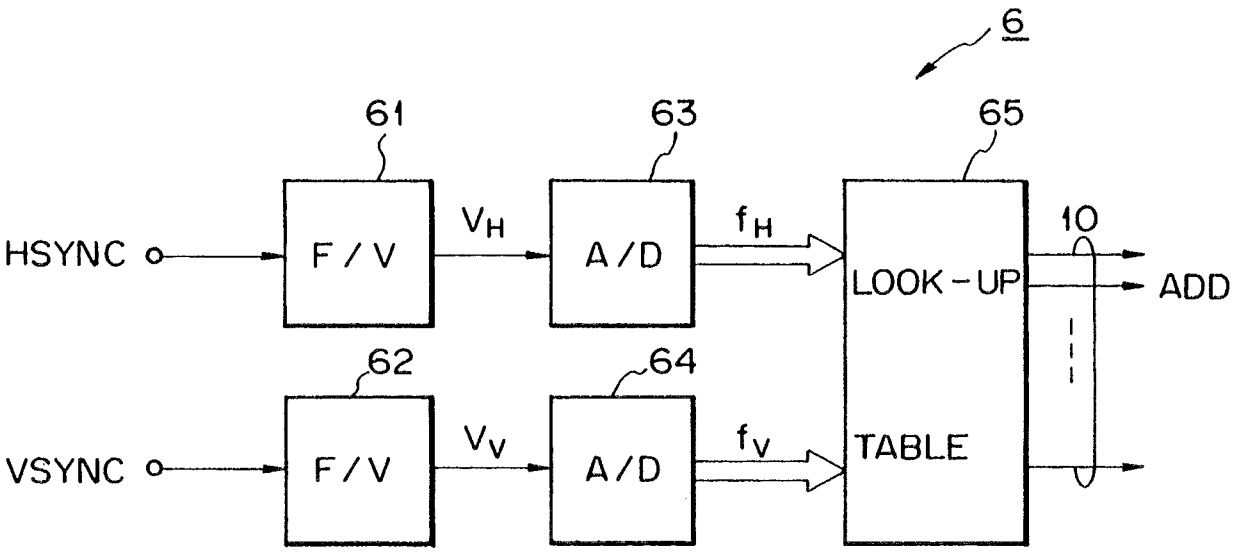
FIG. 6 is a detailed block circuit diagram of the image size determining circuit of FIG. 5.

In FIG. 6, reference numeral 61 designates a frequency-to-voltage converter for receiving the horizontal synchronization signal HSYNC to generate a voltage $V_H$ in response to the frequency of the horizontal synchronization signal HSYNC. Also, reference numeral 62 designates a frequency-to-voltage converter for receiving the vertical synchronization signal VSYNC to generate a voltage $V_V$ in response to the frequency of the vertical synchronization signal VSYNC. The voltages $V_H$ and $V_V$ are converted by analog-to-digital converters 63 and 64 into digital values fand $f_V$, respectively. Then, the digital values $f_H$ and $f_V$ are supplied to a look-up table 65, which in turn generates a 10-bit address signal ADD. Note that the look-up table 65 is formed by a random access memory (RAM) or a read-only memory (ROM) in which the values ΔN defined by the equation (2) are stored in advance. For example, the content of the look-up table 65 is shown in FIG. 7. In this case, note that the value of the address signal ADD is from "0000000000"(=0) to "0111111111"(=511).

Figure 8:
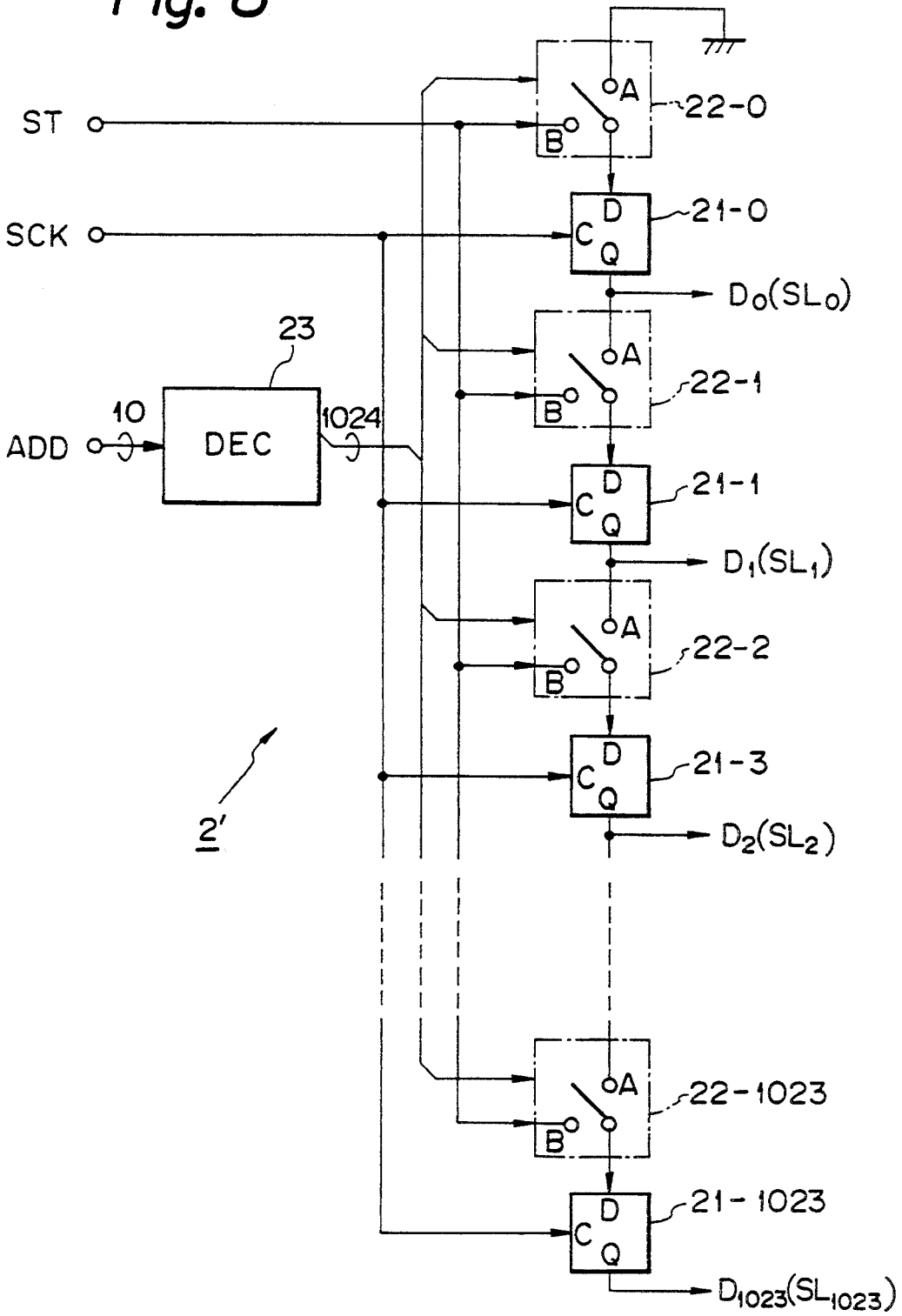
FIG. 8 is a detailed block circuit diagram of the scan line driving circuit of FIG. 5
Figure 9:
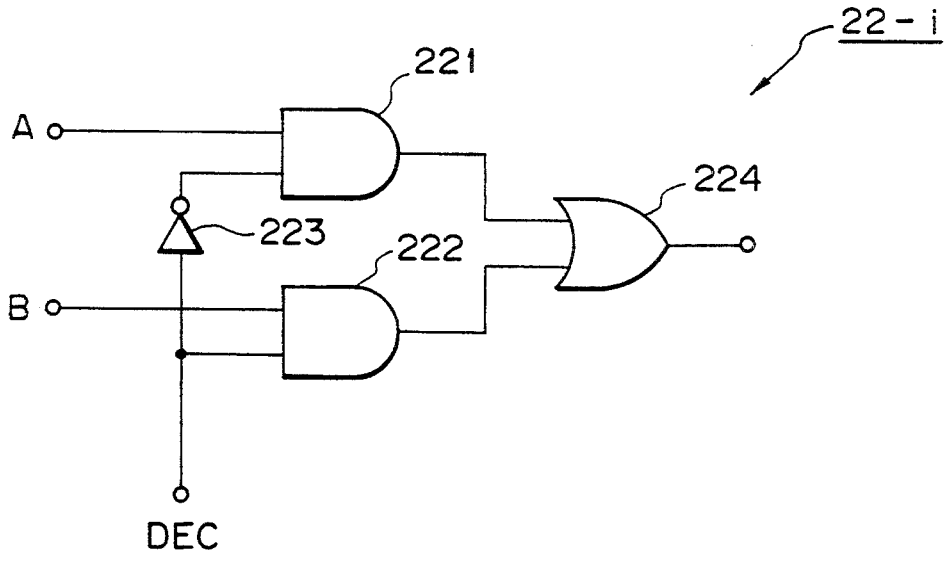
FIG. 9 is a detailed circuit diagram of the switching circuit of FIG. 8.

The details of the scan line driving circuit 2' of FIG. 5 are illustrated in FIG. 8. In FIG. 8, switching circuits 22-0, 22-1, . . . , 22-1023 and a decoder 23 are added to the elements of FIG. 2. The decoder 23 has 1024 output lines each connected to one of the switching circuits 22-0, 22-1, . . . , 22-1023. The switching circuits 22-0, 22-1, . . . , 22-1023 are interposed at the inputs of the shift registers 21-0, 21-1, . . . , 21-1023, respectively, and are selected by the decoder 23. That is, the decoder 23 receives the 10-bit address signal ADD to select one of the switching circuits 22-0, 22-1, . . . , 21-1023, and as a result, only the selected switching circuit selects its B terminal and the other non-selected switching circuits select their A terminals. Each of the switching circuits 22-i (i=0, 1, . . . , 1023) can be formed by two AND circuits 221 and 222, an inverter 223, and an OR circuit 224 as illustrated in FIG. 9.

For example, if an image having 1152×900 dots is displayed on the LCD panel 1, the image size determining circuit 6 generates the address signal ADD whose value is $$(1024-900)2=62(=\text{"0001111101"})$$

Figures 10A, 10B, 10C, 10D, 10E, 10F, 10G, 10H, 10I:
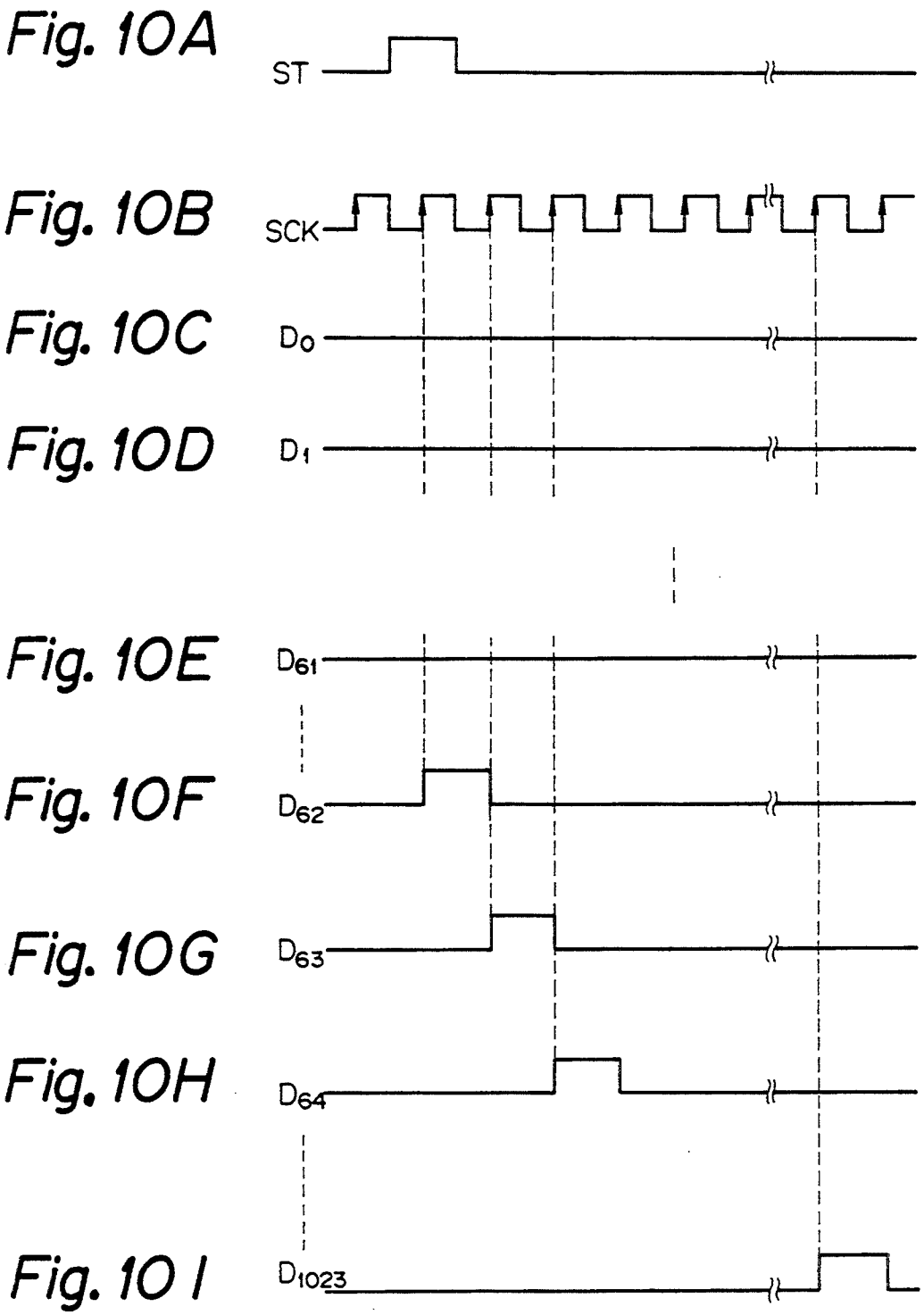
FIGS. 10A through 10I are timing diagrams showing the operation of the circuit of FIG. 5.
Figure 11A:
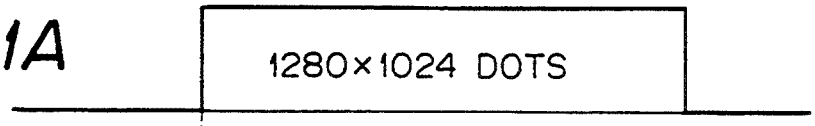
FIGS. 11A, 11B and 11C are timing diagrams of the image signals displayed on the LCD panel of FIG. 5.
Figure 11B:
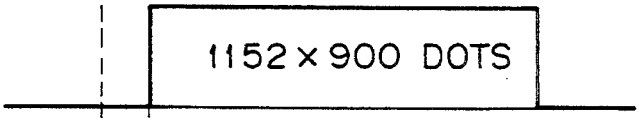
Figure 11C:
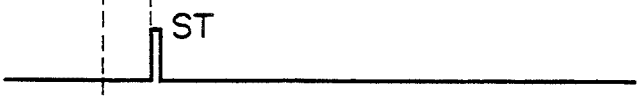
Figure 11D:
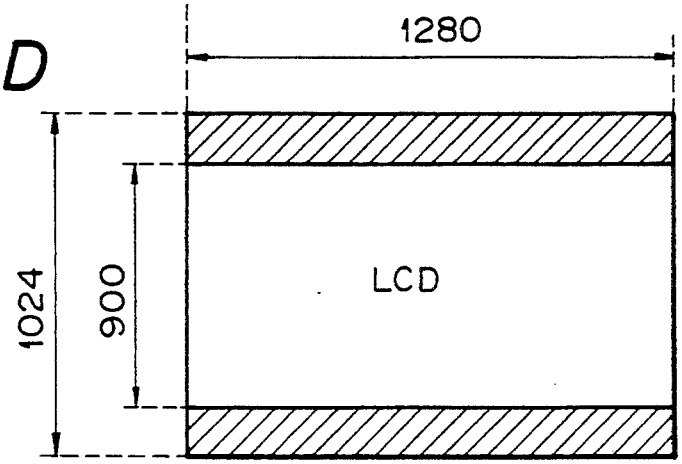
FIG. 11D is a diagram showing images displayed on the LCD panel of FIG. 5.

Therefore, the decoder 23 selects the switching circuit 22-62. As a result, only the switching circuit 22-62 selects its B terminal, and the other switching circuits select their A terminals. Therefore, the start pulse signal ST as shown in FIG. 10A is supplied directly to the shift register 21-62, and the start pulse signal ST is shifted by the shift clock signal SCK as shown in FIG. 10B through the shift registers 21-62 through 21-1023 as shown in FIGS. 10F, 10G, 10H and 10I. In this case, the start pulse signal ST is never written into the shift registers 21-0 through 21-61 as shown in FIGS. 10C, 10D and 10E. As a result, as shown in FIGS. 11A, 11B, 11C and 11D which correspond to FIGS. 4A, 4B, 4C and 4D, respectively, a 1152×900 dot image is balanced at a center portion of the LCD panel 1.

Figure 12:
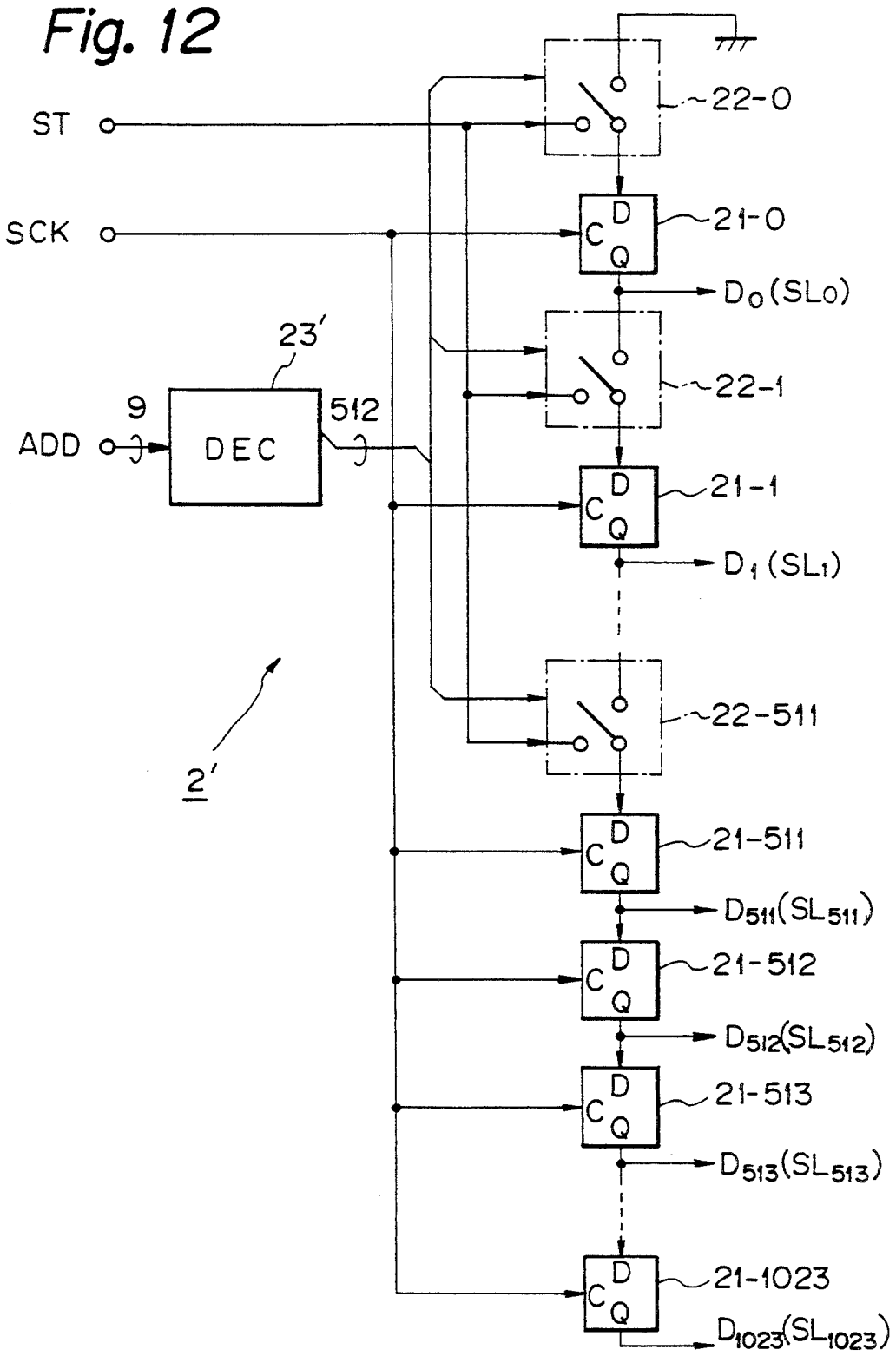
FIG. 12 is a block circuit diagram of one modification of the circuit of FIG. 8.
Figure 13:
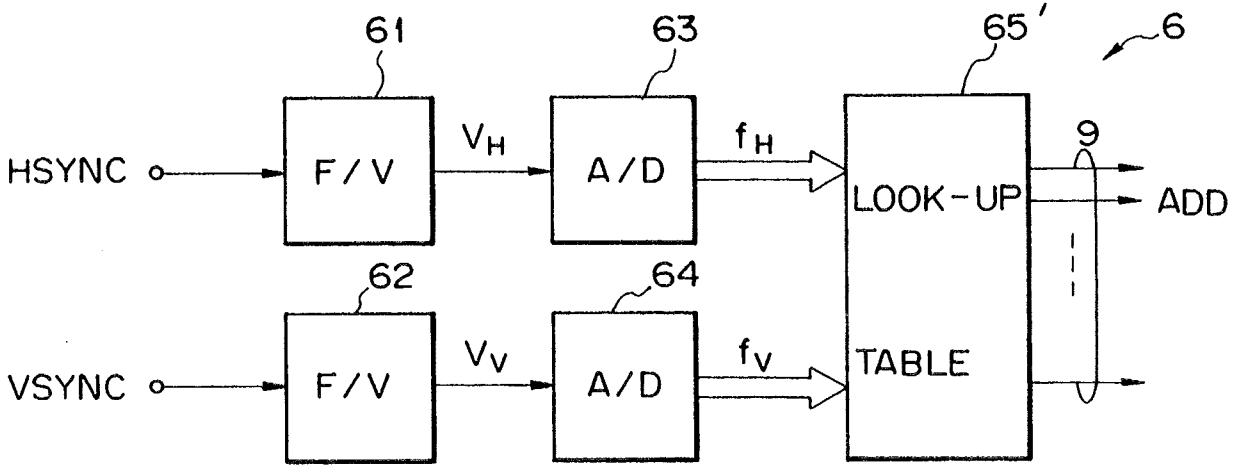
FIG. 13 is a block circuit diagram of one modification of the circuit of FIG. 6.

In FIG. 12, which is a modification of the scan line driving circuit 2' of FIG. 8, the start pulse signal ST is usually supplied to one of the shift registers 21-0 through 21-511 on an upper-half side of the LCD panel 1, not to the shift registers 21-512 through 21-1023 on a lower half side of the LCD panel 1. Therefore, in FIG. 12, the switching circuits 22-512 through 22-1023 of FIG. 8 are not provided. In this case, the output of a decoder 23' is comprised of 512 bits, and therefore, the address signal ADD is comprised of 9 bits. Therefore, in this case, as illustrated in FIG. 13, a look-up table 65' whose content is shown in FIG. 14 is provided instead of the look-up table 65 of FIG. 8.

In the above-mentioned embodiment, although the address signal ADD is generated from the look-up table 65 or 65', the address signal ADD can be generated by a microprocessor which can calculate the equation (2).

As explained hereinbefore, according to the present invention, even an image having a smaller size than an LCD panel can be displayed at a center portion of the LCD panel.

I claim:

1. An apparatus for driving a liquid crystal display panel having M signal lines, N scan lines and M×N liquid crystal cells each connected to one of said M signal lines and one of said N scan lines, said apparatus comprising:

a plurality of shift registers, each having an input terminal, a clock terminal and an output terminal connected to an associated one of said N scan lines, each of said shift registers receiving a data signal at said input terminal and outputting said data signal at said output terminal in response to a scan clock signal supplied to said clock terminal;

start pulse signal generating means for generating a start pulse signal in synchronization with a horizontal synchronization signal;

a plurality of switching circuits, each having a first terminal connected to an output terminal of one of said shift registers and a second terminal connected to an input terminal of another one of said shift registers, said switching circuits and said shift registers being connected in series such that one of said switching circuits is interposed between adjacent ones of said shift registers, each of said switching circuits further having a third terminal connected to said start pulse signal generating means to receive said start pulse signal;

selecting means, connected to said switching circuits, for selecting one of said switching circuits, said one of said switching circuits forming an electrical path between the first terminal and third terminal thereof and with each of remaining ones of said switching circuits and shift registers via an electrical path formed between said first terminal and said second terminal of each of said remaining switching circuits; and means, connected to said plurality of shift registers, for generating and supplying said scan clock signal to said clock terminal of each of said shift registers, said start pulse signal being transferred from said one of said switching circuits to one of said shift registers that has an input terminal connected to said second terminal of said one of said switching circuits and shifted through plural ones of said shift registers including said one of said shift registers.

2. An apparatus for driving a liquid crystal display panel having M signal lines, N scan lines and M×N liquid crystal cells each connected to one of said M signal lines and one of said N scan lines, said apparatus comprising:

a plurality of shift registers, each having an input terminal, a clock terminal and an output terminal connected to an associated one of said N scan lines, each of said shift registers receiving a data signal at said input terminal and outputting said data signal at said output terminal in response to a scan clock signal supplied to said clock terminal;

start pulse signal generating means for generating a start pulse signal in synchronization with a horizontal synchronization signal;

a plurality of switching circuits, each having a first terminal connected to an output terminal of one of said shift registers and a second terminal connected to an input terminal of another one of said shift registers, said switching circuits and said shift registers being connected in series such that one of said switching circuits is interposed between adjacent ones of said shift registers, each of said switching circuits further having a third terminal connected to said start pulse signal generating means to receive said start pulse signal;

selecting means, connected to said switching circuits, for selecting one of said switching circuits, said one of said switching circuits forming an electrical path between the first terminal and said third terminal thereof and with each of remaining ones of said switching circuits and shift registers via an electrical path formed between said first terminal and said second terminal of each of said remaining switching circuits; and means, connected to said plurality of shift registers, for generating and supplying said scan clock signal to said clock terminal of each of said shift registers, said start pulse signal being transferred from said one of said switching circuits to one of said shift registers that has an input terminal connected to said second terminal of said one of said switching circuits and shifted through plural ones of said shift registers including said one of said shift registers;

wherein each of said switching circuits comprises:

a first AND circuit having a first input connected to a prestage one of said plurality of serially-connected shift registers;

a second AND circuit having a first input connected to said start pulse signal generating means; and an OR circuit having a first input and a second input connected to an output of said first AND circuit and said second AND circuit, respectively, one of said first AND circuit and said second AND circuit being enabled by said selecting means and the other being disabled by said selecting means.

3. An apparatus for driving a liquid crystal display panel having M signal lines, N scan lines and M×N liquid crystal cells each connected to one of said M signal lines and one of said N scan lines, said apparatus comprising:

a plurality of shift registers, each having an input terminal, a clock terminal and an output terminal connected to an associated one of said N scan lines, each of said shift registers receiving a data signal at said input terminal and outputting said data signal at said output terminal in response to a scan clock signal supplied to said clock terminal;

start pulse signal generating means for generating a start pulse signal in synchronization with a horizontal synchronization signal;

a plurality of switching circuits, each having a first terminal connected to an output terminal of one of said shift registers and a second terminal connected to an input terminal of another one of said shift registers, said switching circuits and said shift registers being connected in series such that one of said switching circuits is interposed between adjacent ones of said shift registers, each of said switching circuits further having a third terminal connected to said start pulse signal generating means to receive said start pulse signal;

selecting means, connected to said switching circuits, for selecting one of said switching circuits, said one of said switching circuits forming an electrical path between said first terminal and said third terminal thereof and each of remaining ones of said switching circuits and shift registers by forming an electrical path between said first terminal and said second terminal of each of said remaining switching circuits; and means, connected to said shift registers, for generating and supplying said scan clock signal to the clock terminal of each of said shift registers, said start pulse signal being transferred from said one of said switching circuits to one of said shift registers that has an input terminal connected to said second terminal of said one of switching circuits and shifted through plural ones of said shift registers including said one of said shift registers;

wherein said selecting means comprises:

means for calculating a horizontal frequency $f_H$ in accordance with the horizontal synchronization signal;

means for calculating a vertical frequency $f_V$ in accordance with a vertical synchronization signal; and address calculating means, connected to said horizontal frequency calculating means and to said vertical frequency calculating means, for calculating an address in accordance with the horizontal frequency $f_H$ and the vertical frequency $f_V$, wherein said selecting means selects one of said switching circuits in accordance with the address.

4. An apparatus as set forth in claim 3, wherein said horizontal frequency calculating means comprises:

a frequency-to-voltage converter for receiving the horizontal synchronization signal; and an analog-to-digital converter, connected to said frequency-to-voltage converter.

5. An apparatus as set forth in claim 3, wherein said vertical frequency calculating means comprises:

a frequency-to-voltage converter for receiving the vertical synchronization signal and an analog-to-digital converter, connected to said frequency-to-voltage converter.

6. An apparatus as set forth in claim 3, wherein said address calculating means comprises a look-up table.

7. An apparatus as set forth in claim 3, wherein said address calculating means calculates the address ADD by $$ADD=(N-f_H/f_V)/2.$$

8. An apparatus as set forth in claim 3, wherein said selecting means further comprises a decoder, connected to said address calculating means, for generating a selection signal and for transmitting said selection signal to one of said switching circuits.

* * * * *

UNITED STATES PATENT AND TRADEMARK OFFICE

CERTIFICATE OF CORRECTION

PATENT NO. : 5,442,372

DATED : August 15, 1995

INVENTOR(S) : Tatsuya Shiki

It is certified that error appears in the above-indentified patent and that said Letters Patent is hereby corrected as shown below:

Col. 3, line 26, delete "fHfv", and insert -- $f_H/f_V$ --

Col. 3, line 43, delete "fand", and insert -- $f_H$ and --

Col. 4, line 8, delete "900)2", and insert -- 900)/2 --

Signed and Sealed this

Fourteenth Day of November, 1995

*Attest:*

*Attesting Officer*

BRUCE LEHMAN

*Commissioner of Patents and Trademarks*